US006352773B2

(12) United States Patent
Akki et al.

(10) Patent No.: US 6,352,773 B2
(45) Date of Patent: Mar. 5, 2002

(54) FLASH SPINNING POLYMETHYLPENTENE PROCESS AND PRODUCT

(75) Inventors: Rashi Akki, New Castle; Hyunkook Shin, Wilmington, both of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/793,047

(22) Filed: Feb. 26, 2001

Related U.S. Application Data

(62) Division of application No. 09/212,948, filed on Dec. 15, 1998, now Pat. No. 6,270,709.

(51) Int. Cl.[7] ..... D01F 6/00
(52) U.S. Cl. ..... 428/364; 428/373; 428/394
(58) Field of Search ..... 428/364, 373, 428/394

(56) References Cited

U.S. PATENT DOCUMENTS

| | | | | |
|---|---|---|---|---|
| 3,081,519 A | | 3/1963 | Blades et al. | |
| 3,851,023 A | | 11/1974 | Brethauer et al. | |
| 4,608,089 A | | 8/1986 | Gale et al. | |
| 5,032,326 A | | 7/1991 | Shin | |
| 5,147,586 A | | 9/1992 | Shin et al. | |
| 5,202,376 A | * | 4/1993 | Coates et al. | 524/583 |
| 5,250,237 A | | 10/1993 | Shin | |
| 5,279,776 A | | 1/1994 | Shah | |
| 5,286,422 A | | 2/1994 | Kato et al. | |
| 5,985,196 A | * | 11/1999 | Shin et al. | 264/205 |
| 6,096,421 A | * | 8/2000 | Waggoner et al. | 428/373 |
| 6,153,134 A | * | 11/2000 | Shin et al. | 264/50 |

* cited by examiner

*Primary Examiner*—N Edwards

(57) ABSTRACT

A process for flash spinning polymethylpentene alone or as a blend with polyethylene or polypropylene using various spin agents having essentially zero or very low ozone depletion potential.

4 Claims, 4 Drawing Sheets

FLASH SPINNING POLYMETHYLPENTENE PROCESS AND PRODUCT

Divisional of prior application Ser. No.: 09/212,948, now U.S. Pat. No. 6,270,709.

FIELD OF THE INVENTION

This invention relates to flash-spinning of polymeric, plexifilamentary, film-fibril strands. More particularly, this invention relates to flash-spinning of polymethylpentene.

BACKGROUND OF THE INVENTION

U.S. Pat. No. 3,081,519 to Blades and White describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash-spinning causes the liquid to vaporize and thereby cool the exudate which forms a plexifilamentary film-fibril strand of the polymer. Preferred polymers typically include crystalline polyhydrocarbons such as polyethylene and polypropylene.

According to Blades and White, a suitable liquid for flash spinning (a) has a boiling point that is at least 25° C. below the melting point of the polymer; (b) is substantially unreactive with the polymer at the extrusion temperature; (c) should be a solvent for the polymer under the pressure and temperature set forth in the patent (i.e., these extrusion temperatures and pressures are respectively in the ranges of 165 to 225° C. and about 500 to 1500 psia (3447–10342 kPa); (d) should dissolve less than 1% of the polymer at or below its normal boiling point; and (e) should form a solution that will undergo rapid phase separation upon extrusion to form a polymer phase that contains insufficient solvent to plasticize the polymer.

Commercial spunbonded or flash-spun products have been made primarily from polyethylene plexifilamentary film-fibril strands and have typically been produced using trichlorofluoromethane as a spin agent; however, trichlorofluoromethane is an atmospheric ozone depletion chemical, and therefore, alternatives have been under investigation. There have been many other agents used for flash spinning polyethylene to either minimize or eliminate the potential for ozone depletion. Shin, in U.S. Pat. No. 5,032,326 discloses one alternative spin fluid, namely, methylene chloride and a co-spin agent halocarbon having a boiling point between −50° C. and 0° C. Kato et al. in U.S. Pat. No. 5,286,422 discloses an alternative, specifically, a spin fluid of bromochloromethane or 1,2-dichloroethylene and a co-spin agent of, e.g., carbon dioxide, dodecafluoropentane, etc.

As noted above, flashspun products have typically been made from polyethylene, however it is desirable to make flashspun products from other polymers, such as polymethylpentene that have the advantage of a higher melting point than polyethylene.

U.S. Pat. No. 5,250,237 to Shin mentions the use of alcohols with one to four carbons as spin agents for flash spinning polymethylpentene. Also, in a co-pending application assigned to DuPont (Docket No. TK-3315), certain azeotropic mixtures are used as spin agents for polymethylpentene. Regardless, a need exists to find additional solvents suited for polymethylpentene, yet also satisfy the need for non-flammability and zero or extremely low ozone depletion potential.

SUMMARY OF THE INVENTION

The present invention is a process for the preparation of plexifilamentary film-fibril strands of synthetic fiber-forming polyolefin which comprises flash-spinning at a pressure that is greater than the autogenous pressure of the spin fluid into a region of lower pressure, a spin fluid comprising (a) 5 to 30 wgt. % polymethylpentene, and (b) a spin agent selected from the group consisting of hydrochlorofluorocarbons; hydrocarbons; and chlorinated solvents.

This invention is also a spin fluid comprising (a) 5 to 30 wgt. % polymethylpentene and (b) a spin agent selected from the group consisting of hydrocarbons; hydrochlorofluorocarbons; and chlorinated solvents.

This invention is also directed to plexifilamentary film-fibril strands of fiber-forming polymethylpentene having a tenacity of at least 0.5 grams per denier and more preferably having a tenacity of at least 1 gram per denier. Also included are blends of polymethylpentene with polyethylene and polypropylene.

This invention is also directed to a process for the preparation of microcellular foam fibers from synthetic fiber-forming polyolefin which comprises flash-spinning at a pressure that is greater than the autogenous pressure of the spin fluid into a region of lower pressure, a spin fluid comprising (a) at least 40 wgt. % polymethylpentene and (b) a spin agent selected from the group consisting of hydrocarbons; hydrochlorofluorocarbons; and chlorinated solvents.

The invention is further directed to a process for the preparation of discrete plexifilamentary fibers (pulp) from synthetic fiber-forming polyolefins.

BRIEF DESCRIPTION OF THE DRAWINGS

The accompanying drawings, together with the description, serve to explain the principles of the invention, but not to limit the invention.

DETAILED DESCRIPTION OF THE INVENTION

Figure 1:
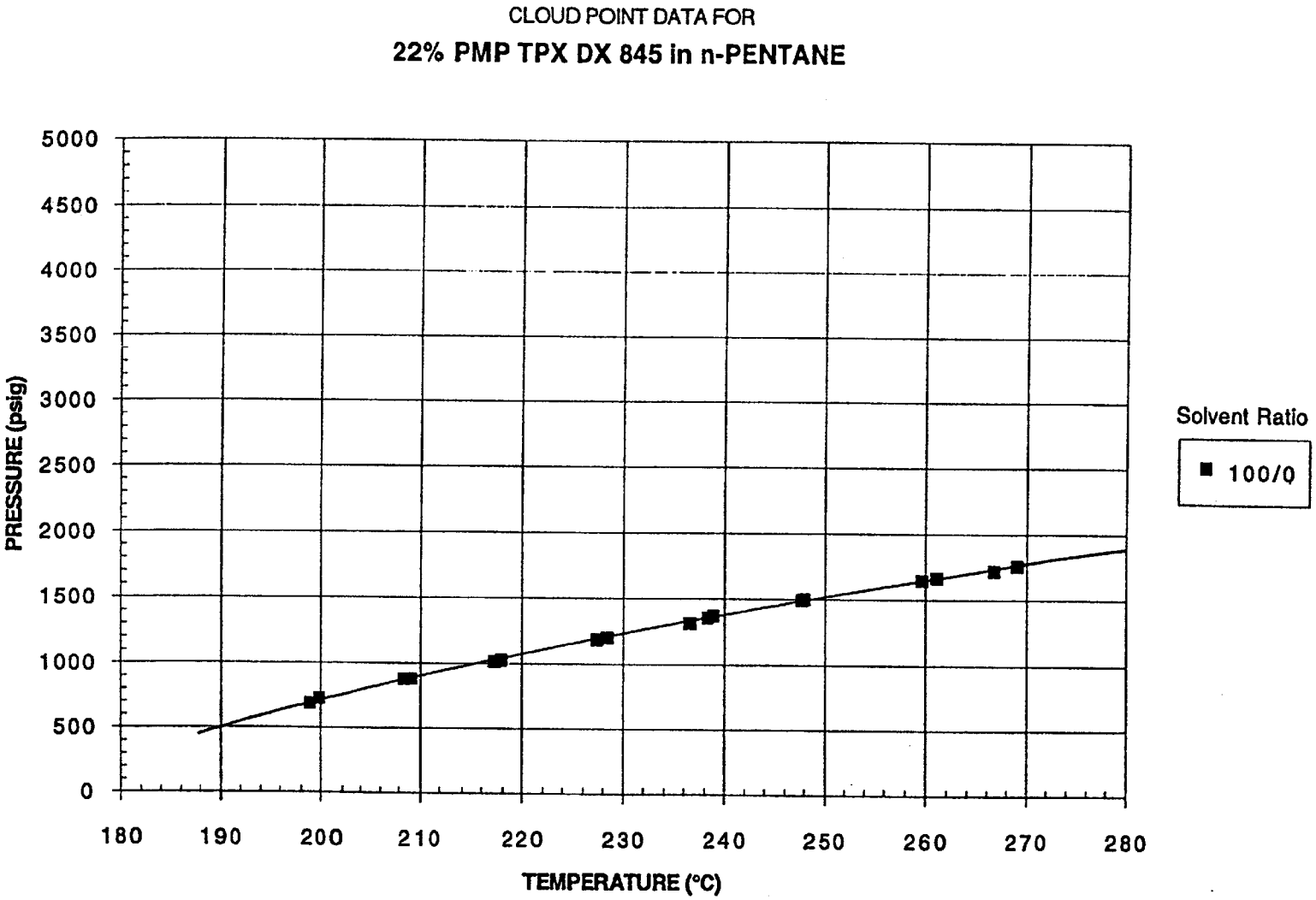
FIG. 1 is a plot of the cloud-point data for a solution comprised of polymethylpentene in a spin agent of n-pentane.
Figure 2:
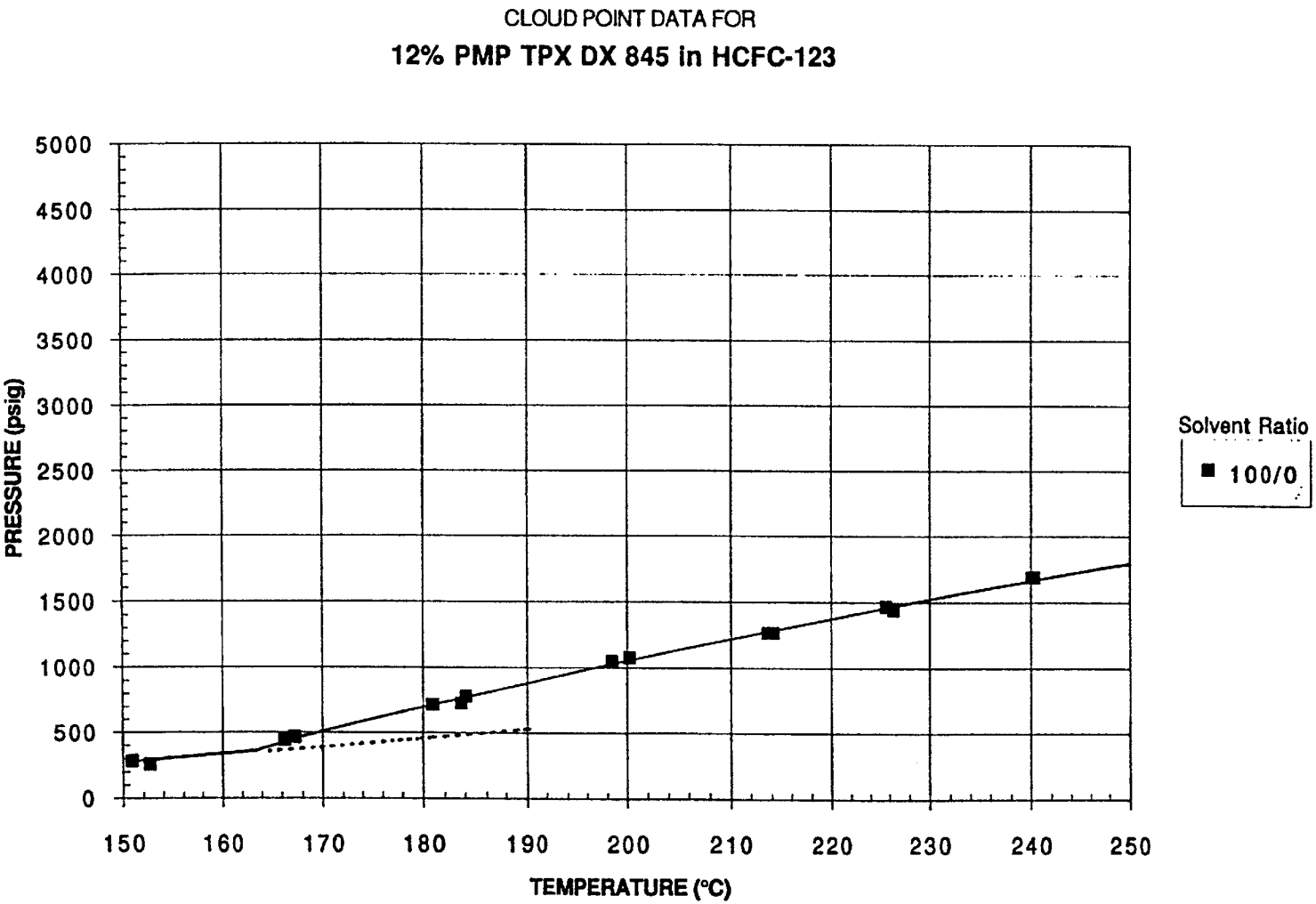
FIG. 2 is a plot of the cloud-point data for a solution comprised of polymethylpentene in a spin agent of dichlorotrifluoroethane (HCFC-123).
Figure 3:
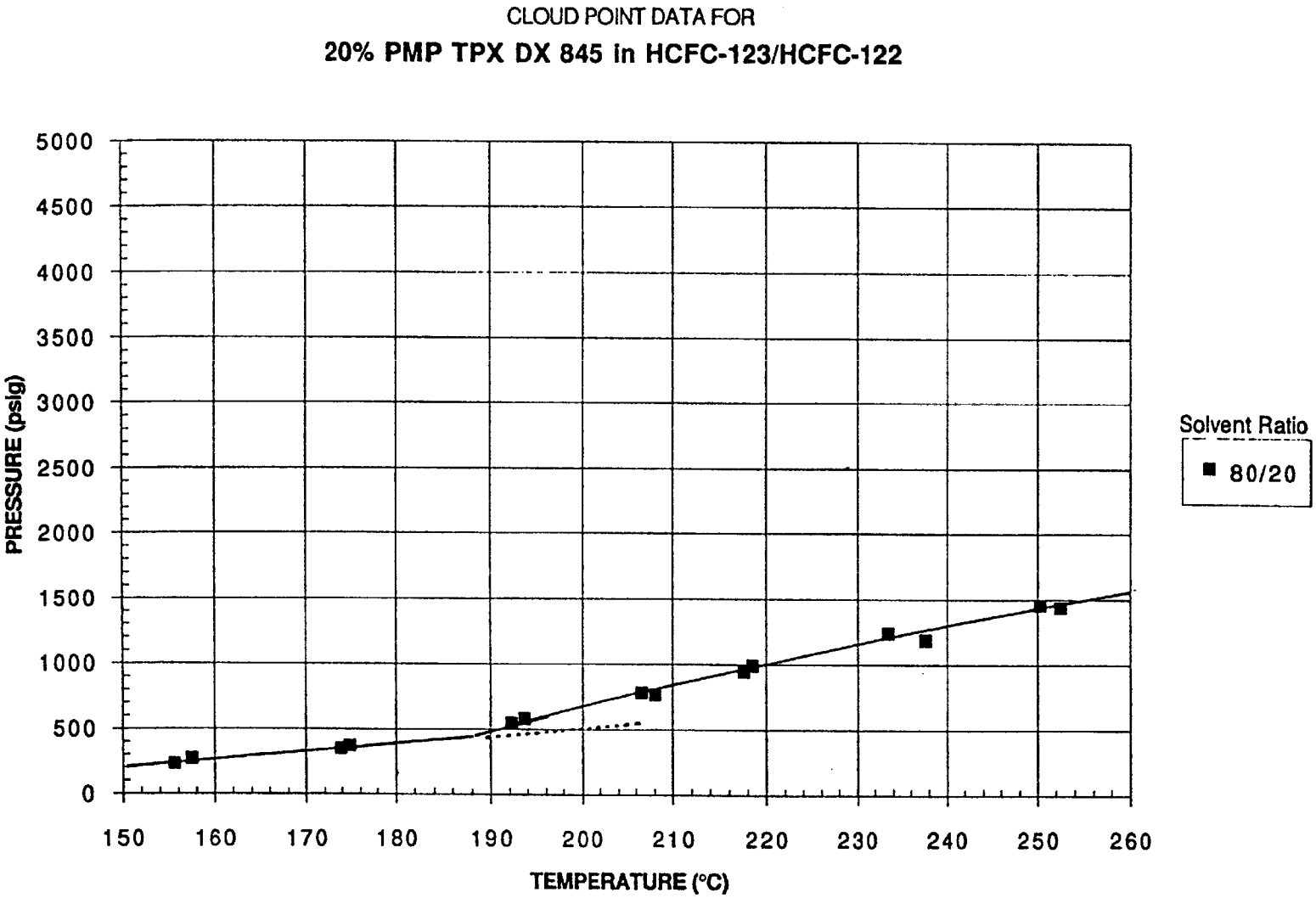
FIG. 3 is a plot of the cloud-point data for a solution comprised of polymethylpentene in a spin agent of HCFC-123 and trichlorodifluoroethane (HCFC-122) as a co-spin agent.
Figure 4:
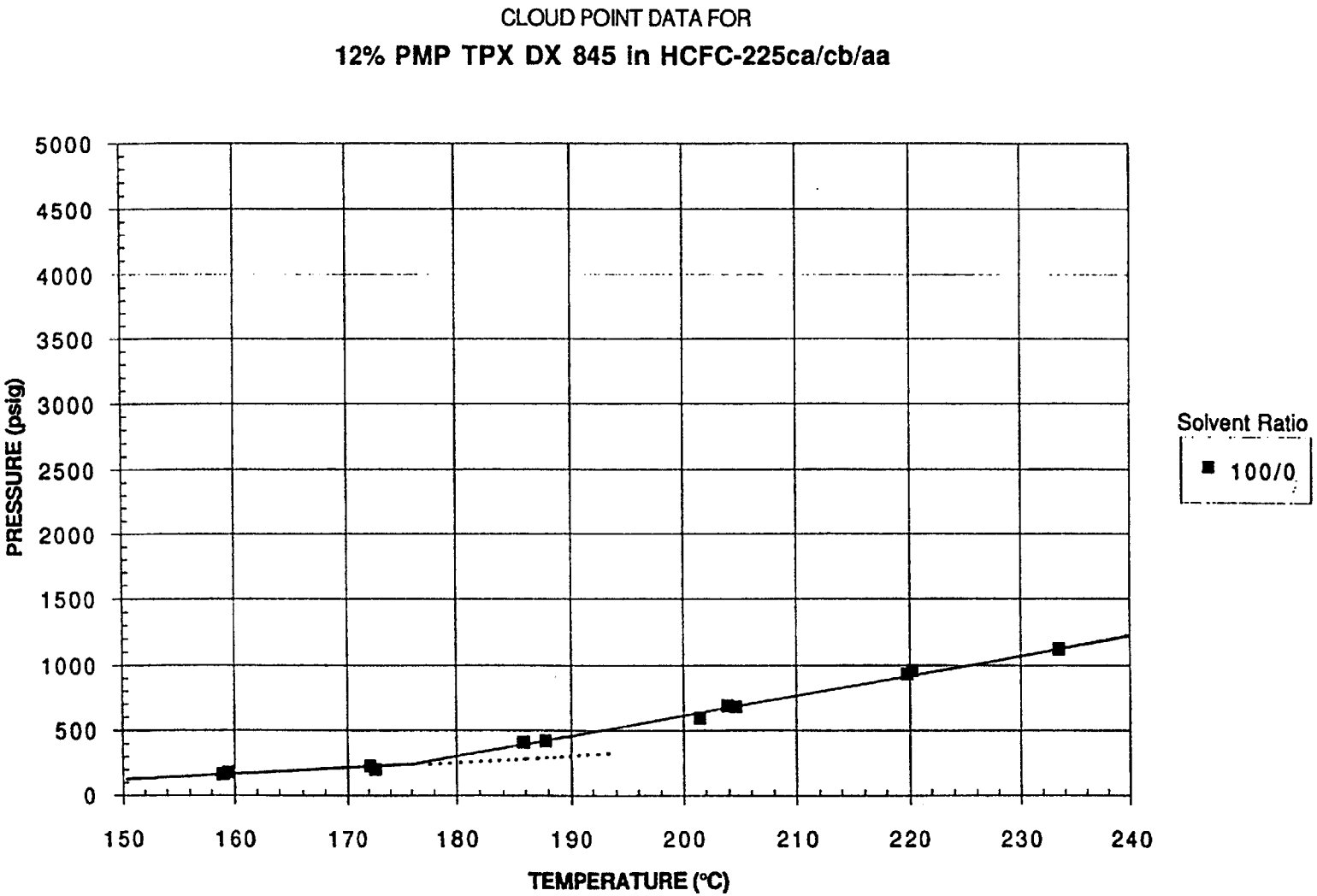
FIG. 4 is a plot of the cloud-point data for a solution comprised of polymethylpentene in a spin agent of dichloropentafluoropropane (HCFC-225).

It is known that polymethylpentene has a higher melting point than either polyethylene or polypropylene (235° C. versus 140° C. and 165° C., respectively) and as such can provide a flashspun product usable at higher temperatures. Nylon and polyester also have high melting points but polymethylpentene is more suited to flash spinning. At this time, there is not a suitable agent for flash spinning nylon and the spin agents for polyester are very limited. The flashspun polymethylpentene (PMP) of this invention exhibits very good fibrillation, but it is further noted that PMP does not have the strength of polyethylene (PE). However, the plexifilamentary fibers herein made from PMP have shown strength greater than 0.5 gram per denier which is sufficient for many purposes. Strength greater than one gram per denier can be achieved.

The term "synthetic fiber-forming polyolefin" herein is intended to encompass certain polymers that can be used in the flash-spinning art, e.g., polymethylpentene, polyethylene and polypropylene. A preferred synthetic fiber-forming polyolefin is polymethylpentene. The term "synthetic fiber-forming polyolefin" may also include polymethylpentene blended with either polyethylene or polypropylene. Blends of PMP with both PE and PP can be used. The PE and PP either separately or both together can be present at 10 to 90% of the total weight of the polyolefin.

The term "polymethylpentene" is intended to embrace not only homopolymers of 4-methylpentene-1 but also copolymers where at least 85% of the recurring units are polymerized units of 4-methylpentene-1. The term "polypropylene" is intended to embrace not only homopolymers of propylene but also copolymers where at least 85% of the recurring units are polymerized units of propylene. The term "polyethylene" is intended to embrace not only homopolymers of polyethylene but also copolymers where at least 85% of the recurring units are polymerized units of ethylene.

The preferred process for making plexifilamentary materials employs a spin fluid in which the synthetic fiber-forming polyolefin concentration is in the range of 6 to 22 wgt. %. The range may depend somewhat on whether low density or high density spin agents are used. For example, if a high density spin agent, such as a hydrochlorofluorocarbon were used, the wgt. % of polyolefin would be lower. The term spin fluid as used herein means the solution comprising the fiber-forming polyolefin, the spin agent and any co-spin agent that may be present. Unless noted otherwise, the term wgt. % as used herein refers to the percentage by weight based on the total weight of the spin fluid. The spin agent may be selected from the group consisting of hydrocarbons; hydrochlorofluorocarbons; and chlorinated solvents. Some specific examples of spin agents are cyclopentane, dichlorotrifluoroethane (HCFC-123) and n-pentane.

Co-spin agents can be used to either raise or lower the cloud-point pressure of the spin fluid. To raise the cloud-point pressure, the co-spin agent in the spin fluid must be a "non-solvent" for the polymer or at least a poorer solvent than the primary spin agent. In other words, the solvent power of the co-spin agent of the spin fluid used must be such that if the polymer to be flash-spun were to be dissolved in the co-spin agent alone, typically, the polymer would not dissolve in the co-spin agent, or the resultant solution would have an unacceptably high cloud-point pressure. It is noted that the general term "spin agent" may refer to a primary spin agent when used alone or to the primary spin agent combined with a co-spin agent. Trichlorodifluoroethane (HCFC-122) is an example of a co-spin agent used in the subject invention which lowers the cloud-point pressure.

The term "cloud-point pressure" as used herein, means the pressure at which a single phase liquid solution begins to phase separate into a polymer-rich/spin liquid-rich two-phase liquid/liquid dispersion. However, at temperatures above the critical point, there cannot be any liquid phase present and therefore a single phase, supercritical solution phase separates into a polymer-rich/spin fluid-rich, two-phase gaseous dispersion.

In order to spread the web formed when polymers are flash spun in the commercial operations, the flash spun material is projected against a rotating baffle and then subjected to an electrostatic charge; see, for example, Brethauer et al. U.S. Pat. No. 3,851,023.

Pulp of discontinuous plexifilamentary fibers can be made from PMP alone or from PMP blended with PE and/or PP. The pulp of this invention can be produced by disc refining flash spun plexifilaments as disclosed in U.S. Pat. No. 4,608,089 to Gale & Shin. Alternatively, the pulp can be prepared directly from polymer solutions by flash spinning using a device similar to the one disclosed in U.S. Pat. No. 5,279,776 to Shah.

The pulp made by this invention is comprised of plexifilamentary film-fibrils and can have a three-dimensional network structure. However, the pulp fibers are relatively short in length and have small dimensions in the transverse direction. Their average length is less than about 5 mm and their average diameter is less than about 200 micrometers, preferably less than about 50 micrometers. They typically have relatively high surface area; greater than about 1 square meter per gram when determined by the BET method as further explained below.

Microcellular foams can be obtained by flash-spinning and are usually prepared at relatively high polymer concentrations in the spinning solution, i.e., at least 40 wgt. % synthetic fiber-forming polyolefin. Polymethylpentene is preferred but the synthetic fiber-forming polyolefin may also include polymethylpentene blended with either polyethylene or polypropylene. Blends of PMP with both PE and PP can also be used. Also, relatively low spinning temperatures and pressures that are above the cloud-point pressure can be used. Microcellular foam fibers may be obtained rather than plexifilaments, even at spinning pressures slightly below the cloud-point pressure of the solution. Spin agents used are the same as those noted above for plexifilamentary, film-fibril materials.

Nucleating agents, such as fumed silica and kaolin, are usually added to the spin mix to facilitate spin agent flashing and to obtain uniform small size cells.

Microcellular foams can be obtained in a collapsed form or in a fully or partially inflated form. For many polymer/solvent systems, microcellular foams tend to collapse after exiting the spinning orifice as the solvent vapor condenses inside the cells and/or diffuses out of the cells. To obtain low density inflated foams, inflating agents are usually added to the spin liquid. Suitable inflating agents that can be used include low boiling temperature partially halogenated hydrocarbons, such as, hydrochlorofluorocarbons and hydrofluorocarbons; or fully halogenated hydrocarbons, such as chlorofluorocarbons and perfluorocarbons; hydrofluoroethers; inert gases such as carbon dioxide and nitrogen; low boiling temperature hydrocarbon solvents such as butane and isopentane; and other low boiling temperature organic solvents and gases.

Microcellular foam fibers are normally spun from a round cross section spin orifice. However, an annular die similar to the ones used for blown films can be used to make microcellular foam sheets.

EXAMPLES

Test Methods

In the description above and in the non-limiting examples that follow, the following test methods were employed to determine various reported characteristics and properties. ASTM refers to the American Society of Testing Materials, and TAPPI refers to the Technical Association of the Pulp and Paper Industry.

The denier of the strand is determined from the weight of a 15 cm sample length of strand under a predetermined load.

Tenacity, elongation and toughness of the flash-spun strand are determined with an Instron tensile-testing machine. The strands are conditioned and tested at 70° F. (21° C.) and 65% relative humidity. The strands are then twisted to 10 turns per inch and mounted in the jaws of the Instron Tester. A two-inch gauge length is used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

The surface area of the plexifilamentary film-fibril strand product is another measure of the degree and fineness of fibrillation of the flash-spun product.

Surface area is measured by the BET nitrogen absorption method of S. Brunauer, P. H. Emmett and E. Teller, J. Am. Chem. Soc., V. 60 p 309–319 (1938) and is reported as $m^2/g$.

Test Apparatus for Examples 1–23

The apparatus used in the examples is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with a length and a diameter each measuring 30 mils (0.762 mm). The pistons are driven by high pressure water supplied by a hydraulic system.

In the tests reported in Examples 1–23, the apparatus described above was charged with pellets of a polyolefin and a spin agent. High pressure water was used to drive the pistons to generate a mixing pressure of between 1500 and 3000 psig (10,239–20,478 kPa). The polymer and spin agent were next heated to mixing temperature and held at that temperature for a specified period of time during which the pistons were used to alternately establish a differential pressure of about 50 psi (345 kPa) or higher between the two cylinders so as to repeatedly force the polymer and spin agent through the mixing channel from one cylinder to the other to provide mixing and to effect formation of a spin mixture. The spin mixture temperature was then raised to the final spin temperature, and held there for about 15 minutes or longer to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice is opened about one to three seconds after the opening of the valve between the spin cell and the accumulator. This period roughly corresponds to the residence time in the letdown chamber of a commercial spinning apparatus. The resultant flash-spun product is collected in a stainless steel open mesh screen basket. The pressure recorded just before the spinneret using a computer during spinning is entered as the spin pressure.

The experimental conditions and the results for Examples 1–16 are given below in Tables 1–3. It is noted that pressures may be expressed as psig which is pounds per square inch gage which is ~15 psi less than psia (pound per square inch absolute). The unit psi is considered the same as psia. For converting to SI units, 1 psi=6.9 kPa. When an item of data was not measured, it is noted in the tables as nm.

EXAMPLES 1–10

In Examples 1–10, samples of TPX DX845 polymethylpentene were obtained from Mitsui Plastics, Inc. (White Plains, N.Y.). Dichlorotrifluoroethane (HCFC-123) was used as the spin agent. The PMP had a melt flow index of 8 g/10 min and a density of 0.835 $g/cm^3$ and was used at various concentrations.

Weston 619F, a diphosphite thermal stabilizer from GE Specialty Chemicals, was added at 0.1 wgt. % based on the total weight of the spin agent. Acceptable plexifilamentary fibers were obtained with properties as presented in Table 1. It should be noted that the relatively short mixing time shown reflects the mixing after the desired spin temperature has been reached and that mixing was occurring while the solution was being heated to the spin temperature (typically about 30 minutes).

TABLE 1

PMP Plexifilamentary Fibers

| | | Tot. | Mixing | | | Spinning | | | Properties | | | | |
|---|---|---|---|---|---|---|---|---|---|---|---|---|---|
| No. | N.B. Code | wt. % | ° C. | Min | Back psig | Spinneret, mils | Accum. psig | ° C. | Den | Twist per inch | Mod gpd | Ten gpd | E % |
| 1 | E91514-92 | 10 | 190 | 1 | 1700 | 15 × 15 | 1000 | 190 | 43 | 24.7 | 4.24 | 1.1 | 46 |
| 2 | E91514-94 | 10 | 220 | 1 | x | 15 × 15 | 1500 | 220 | 52 | 21.7 | 2.47 | 1.1 | 46 |
| 3 | E91514-96 | 10 | 200 | 1 | 1610 | 15 × 15 | 1200 | 200 | 47 | 23.7 | 2.28 | 0.8 | 52 |
| 4 | E91514-99 | 10 | 220 | 1 | 2220 | 15 × 15 | 1600 | 220 | 49 | 23.1 | 1.94 | 0.8 | 44 |
| 5 | E91514-100 | 10 | 240 | 1 | 2600 | 15 × 15 | 2000 | 240 | 51 | 22.1 | 2.1 | 0.8 | 47 |
| 6 | E91514-103 | 10 | 240 | 1 | 2600 | 30 × 30 | 2000 | 240 | 144 | 13.2 | 3.46 | 1.1 | 54 |
| 7 | E91514-104 | 8 | 220 | 1 | 2500 | 30 × 30 | 1900 | 220 | 166 | 12.3 | 1.4 | 0.5 | 57 |
| 8 | E91514-105 | 10 | 220 | 1 | 2200 | 30 × 30 | 1600 | 220 | 144 | 13 | 2.75 | 1.2 | 54 |
| 9 | E91514-106 | 8 | 200 | 1 | 2050 | 30 × 30 | 1450 | 200 | 106 | 15 | 3.55 | 1.1 | 64 |
| 10 | E91514-110 | 8 | 220 | 1 | 2500 | 15 × 15 | 1900 | 220 | 43 | 24 | 1.71 | 0.8 | 58 |

EXAMPLES 11–13

In Examples 11–13, samples of PMP as described in Examples 1–10 were used. Various solvents as shown in Table 2 were used as spin agents.

Weston 619F, a diphosphite thermal stabilizer from GE Specialty Chemicals, was added at 0.1 wgt. % based on the total weight of the spin agent. Acceptable plexifilamentary fibers were obtained with properties as presented in Table 2.

TABLE 2

| PMP Plexifilamentary Fibers | | | | | | | |
|---|---|---|---|---|---|---|---|
| Polymer | | | Solvent | Mixing | | | |
| No. | N.B. Code | Tot. Wt. % | Type | ° C. | Min | Back psig | Delta P |
| 11 | P11774-151 | 20 | HCFC-225 | 180–250 | 20 | 2000 | 300 |
| 12 | P11774-152 | ~22 | 80/20 HCFC-123/ HCFC-122 | 160–250 | 27 | 2000 | 300 |
| 13 | P11815-5 | 22 | n-Pentance | 125–250 | 25 | 2200 | 200 |

| Spinning | | | Properties @ 10 tpi | | | | |
|---|---|---|---|---|---|---|---|
| ACCUM. | SPIN | T | | | | | |
| P psig | psig | ° C. | gms load | Den | Mod gpd | Ten | E % |
| 1050 | ~950 | 250 | 40 | 379 | 4.2 | 1.01 | 50 |
| 1300 | 1200 | 251 | 40 | 502 | 3.3 | 1.04 | 53 |
| 1325 | 1225 | 250 | 40 | 180 | 2.4 | 1.2 | 44 |

EXAMPLES 14–15

In Examples 14–15, polymethylpentene as described in Examples 1–10 was blended with ALATHON® high density polyethylene obtained from Lyondell Petrochemical Co., Houston, Tex. The polyethylene had a melt index of 0.75, a number average molecular weight of 27,000 and a molecular weight distribution (MWD) of 4.43. MWD is the ratio of weight average molecular weight to number average molecular weight. The spin agent used was n-pentane. The PMP and PE were blended at various weight percentages of the polyolefin. The total weight percentage of the blended polyolefin in the spin fluid was 20%.

Weston 619F, a diphosphite thermal stabilizer from GE Specialty Chemicals, was added at 0.1 wgt. % based on the total weight of the spin agent.

TABLE 3

| Plexifilaments From PMP/HDPE Blends | | | | | | | | |
|---|---|---|---|---|---|---|---|---|
| | | Polymer | | | | | | |
| | | | P/P | Solvent | Mixing | | | |
| No. | N.B. Code | Name | % | Type | ° C. | Min | Back psig | ΔP |
| 14 | P11547-96 | PMP<br>PE | 25<br>75 | n-Pentane | 180 | 60 | 2500 | 300 |
| 15 | P11547-76 | PMP<br>PE | 50<br>50 | n-Pentane | 180 | 60 | 2500 | 300 |

| Spinning | | | Properties @ 10 tpi | | | | |
|---|---|---|---|---|---|---|---|
| ACCUM. | SPIN | T | | | | | |
| P psig | psig | ° C. | gms load | Den | Mod gpd | Ten gpd | E % |
| 1400 | 1300 | 183 | 40 | 322 | 7.1 | 2.4 | 64 |
| 1800 | 1800 | 181 | 40 | 678 | 5.7 | 1.77 | 65 |

EXAMPLE 16

Microcellular foam was made in this example by mixing and spinning polymethylpentene at selected pressures and temperatures using the indicated spin agents. The spinneret hole measured 30 mil×30 mil (diameter×length). A sample of TPX DX 845 polymethylpentene was mixed in a spin agent of HCFC-123. The polymethylpentene was present at 60 wgt. % of the spin fluid. The additive used was 0.1 wgt. % of Weston 619F thermal stabilizer based on the weight of the spin agent. Mixing was done at 190° C. for 5 min at 1800 psig (12307 kPa). Spinning took place at a 900 psig (6154 kPa) accumulator pressure with the spinning being done at a lower pressure at 190° C. Acceptable microcellular foam was obtained.

What is claimed is:

1. Plexifilamentary film-fibril strands of fiber-forming polymethylpentene having a tenacity of at least 0.5 grams per denier.

2. The plexifilamentary film-fibril strands of claim 1 having a tenacity of at least 1 gram per denier.

3. The plexifilamentary film-fibril strands of claim 1 or 2 made from a polymer mixture further comprising at least one of the group of polyethylene and polypropylene.

4. The plexifilamentary film-fibril strands of claim 3 wherein at least one of the group of polyethylene and polypropylene is present at 10 to 90 wgt. % of the total polymer mixture.

* * * * *